US007083007B2

(12) United States Patent
Herst

(10) Patent No.: US 7,083,007 B2
(45) Date of Patent: Aug. 1, 2006

(54) FINGERBOARD WITH PNEUMATICALLY ACTUATED FINGER LATCHES

(75) Inventor: Neil Herst, Houston, TX (US)

(73) Assignee: Varco I/P, Inc., Orange, CA (US)

( * ) Notice: Subject to any disclaimer, the term of this patent is extended or adjusted under 35 U.S.C. 154(b) by 496 days.

(21) Appl. No.: 10/696,689

(22) Filed: Oct. 29, 2003

(65) Prior Publication Data

US 2005/0092524 A1 May 5, 2005

(51) Int. Cl.
*E21B 19/14* (2006.01)

(52) U.S. Cl. ..... 175/52; 175/85; 211/70.4; 414/22.51; 141/258

(58) Field of Classification Search ..... 175/85, 175/52; 141/234, 235, 258; 137/118.01, 137/118.07, 628, 862; 414/22.51, 22.62, 414/22.63, 22.64, 22.68, 22.71; 211/70.4
See application file for complete search history.

(56) References Cited

U.S. PATENT DOCUMENTS

| | | | | |
|---|---|---|---|---|
| 1,804,962 | A | | 5/1931 | Thorpe |
| 2,311,933 | A | | 2/1943 | Deckard |
| 2,423,169 | A | | 7/1947 | Bennett |
| 2,569,928 | A | * | 10/1951 | Gonzalez ..... 222/136 |
| 2,619,234 | A | | 11/1952 | Stone |
| 2,773,605 | A | | 12/1956 | Jarnett |
| 3,501,017 | A | | 3/1970 | Johnson et al. |
| 3,701,435 | A | | 10/1972 | Woolslayer et al. |
| 3,768,663 | A | | 10/1973 | Turner, Jr. et al. |
| 3,799,364 | A | | 3/1974 | Kelly et al. |
| 3,800,962 | A | | 4/1974 | Ham |
| 3,844,402 | A | | 10/1974 | Walling et al. |
| 4,042,123 | A | | 8/1977 | Sheldon et al. |
| 4,044,895 | A | | 8/1977 | Adair |
| 4,269,554 | A | | 5/1981 | Jackson |
| 4,531,875 | A | | 7/1985 | Krueger |
| 4,725,179 | A | | 2/1988 | Woolslayer et al. |
| 6,543,551 | B1 | | 4/2003 | Sparks et al. |

FOREIGN PATENT DOCUMENTS

GB 2 175 629 A 12/1986

OTHER PUBLICATIONS

International Search Report for International Application No. PCT/US2003/034490 filed Oct. 29, 2003, mailed May 25, 2005, 5 pgs.

* cited by examiner

*Primary Examiner*—Kenneth Thompson
(74) *Attorney, Agent, or Firm*—Christie, Parker & Hale, LLP

(57) ABSTRACT

A fingerboard having at least one fingerboard row for storing a plurality of threaded tubulars is provided. A plurality of latches are connected to the at least one fingerboard row for lockingly retaining at least one threaded tubular, wherein each of the plurality of latches is movable between a locked position and an unlocked position. A row controller is connected to each of the latches for individually and sequentially moving the latches between the locked and unlocked positions, wherein the row controller is manually operable from a location remote from the latches such that the latches are manually and remotely controlled.

26 Claims, 8 Drawing Sheets

22
28
58A
58
58B
24
26
34C
34B
34A
32C
32B
32A 22
28
30
34C
34B
34A
40
42
24
32A
26
27
32C
32B
32A 22
28
54B
34C
34B
34A
40
42
32A
26
24
32C
32B
32A
27

22
28
30
36
34C
34B
34A
40
42
54A
32A
26
24
32C
32B
32A
44
46
27

22
28
58
58B
60

FINGERBOARD WITH PNEUMATICALLY ACTUATED FINGER LATCHES

FIELD OF THE INVENTION

The present invention relates generally to a fingerboard for storing threaded tubulars for use in oil and gas well drilling systems, and more specifically to a fingerboard having pneumatically actuated finger latches.

BACKGROUND OF THE INVENTION

Oil and gas well drilling systems include numerous types of piping, referred to generally as "tubulars". Tubulars include drill pipes, casings, and other threadably connectable oil and gas well structures. Long "strings" of joined tubulars, or drill strings, are typically used to drill a wellbore and to prevent collapse of the wellbore after drilling. The drill strings are typically stored in a structure commonly referred to as a fingerboard. Fingerboards typically include a plurality of vertically elongated support structures or "fingers" each capable of receiving a plurality of drill strings. Each drill string is typically individually secured to one of the fingers by a corresponding latch, which is movable between a locked and an unlocked position.

In some prior fingerboards, the latches are manually moved between the locked and unlocked positions by an oil or gas well worker who walks across the fingers to manually move the latches to the desired locked or unlocked position. Due to the extreme height of the fingers, (in some instances 90 feet tall or taller) the manual operation of the latches by the worker is undesirably dangerous. This practice is particularly dangerous when the worker moves the latches between the locked and unlocked position by kicking the latches into or out of the locked position as the worker walks across the fingers, which is not an uncommon practice.

In an effort to make fingerboards less dangerous some manufacturers include automated latches that are controlled remote from the latches. Although these latches decrease the danger to the worker, they are much more complicated and much more expensive than manually operated latches. Accordingly, a need exists for a fingerboard having an inexpensive latch system that is safe to operate.

SUMMARY OF THE INVENTION

In one embodiment, the present invention is a fingerboard having at least one fingerboard row for storing a plurality of threaded tubulars. A plurality of latches are connected to the at least one fingerboard row for lockingly retaining at least one threaded tubular, wherein each of the plurality of latches is movable between a locked position and an unlocked position. A row controller is connected to each of the latches for individually and sequentially moving the latches between the locked and unlocked positions, wherein the row controller is manually operable from a location remote from the latches such that the latches are manually and remotely controlled.

In another embodiment, the present invention is a fingerboard having at least one fingerboard row for storing a plurality of threaded tubulars. A plurality of latches are connected to the at least one fingerboard row, wherein each of the plurality of latches is biased into a locked position and movable between the locked position and an unlocked position. A piston having an elongated rod is slidingly engaged with a casing, wherein the casing has a plurality of exhaust ports in fluid connection therewith, and wherein each of the plurality of exhaust ports is connected to a corresponding one of the plurality of latches. An air source is in fluid connection with the casing, wherein the elongated rod is movable between a fully retracted position and a plurality of extended positions corresponding to each of the plurality of exhaust ports, wherein in the fully retracted position each of the exhaust ports are covered by the elongated rod, such that air from the air source cannot flow therethrough allowing each of the corresponding latches to be biased in the locked position, and wherein in each successive one of the plurality of extended positions a successive one of the plurality of exhaust ports is uncovered such that air flows therethrough to force a successive one of the corresponding latches to move from the locked position to the unlocked position.

In yet another embodiment, the present invention is a fingerboard having at least one fingerboard row for storing a plurality of threaded tubulars. A plurality of latches are connected to the at least one fingerboard row, wherein each of the plurality of latches is biased into a locked position and movable between the locked position and an unlocked position. A piston having an elongated rod is slidingly engaged with a casing, wherein the casing has a plurality of exhaust ports in fluid connection therewith. Each of a plurality of conduits fluidly connects one of the plurality of exhaust ports to a corresponding one of the plurality of latches. An air source is in fluid connection with the casing, wherein the elongated rod is movable between a fully retracted position and a plurality of extended positions corresponding to each of the plurality of exhaust ports, wherein in the fully retracted position each of the exhaust ports are covered by the elongated rod, such that air from the air source cannot flow therethrough allowing each of the corresponding latches to be biased in the locked position, and wherein in each successive one of the plurality of extended positions a successive one of the plurality of exhaust ports is uncovered such that air flows therethrough to force a successive one of the corresponding latches to move from the locked position to the unlocked position. A piston guide is connected to the piston and has a plurality of stop positions, wherein each of the plurality of stop positions corresponds to one of the plurality of extended positions of the elongated rod.

In still yet another embodiment, the present invention is a method of storing a plurality of threaded tubulars in a fingerboard including providing a fingerboard row for storing the plurality of threaded tubulars; providing a casing having a plurality of exhaust ports, wherein each of the plurality of exhaust ports corresponds to at least one of the plurality of threaded tubulars; and providing a piston having an elongated rod that is moveable relative to the casing. The method further includes connecting a plurality of latches to the fingerboard row, wherein each of the plurality of latches is connected to a corresponding one of the plurality of exhaust ports and each latch is biased to a closed position and moveable between the closed position and an opened position; connecting an air source to the casing; moving the elongated rod to a fully extended position such that each exhaust port is uncovered by the elongated rod and air from the air source enters each uncovered exhaust port and forces each of the latches into a unlocked position; adding successive ones of the plurality of threaded tubulars to a position within the fingerboard row; and moving the elongated rod to one of a plurality of retracted positions to cover the corresponding exhaust port of each added threaded tubular causing each latch to be biased from the unlocked position to the locked position to lock each added threaded tubular to the fingerboard row.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

As shown in FIGS. 1–8B, embodiments of the present invention are directed to a fingerboard for storing a plurality of threaded tubulars. The fingerboard has a plurality of latches for securing the threaded tubulars to the fingerboard. Each latch is connected to a corresponding exhaust port of a casing. The casing is connected to an air supply. The casing is also connected to a piston that is movable relative to the casing to cover or uncover each of the exhaust ports to guide the flow of air from the air supply. When an exhaust port is uncovered, air from the air supply enters a corresponding latch to move the latch from a locked position to an unlocked position. When an exhaust port is covered, air from the air supply is prevented from entering the corresponding latch and the latch returns to the locked position.

In a fully retracted position, the piston covers each of the exhaust ports, such that air is prevented from entering each of the corresponding latches and each of the corresponding latches is held in the locked position to secure a corresponding threaded tubular to the fingerboard. In this position, the piston may be moved in an extending direction to sequentially uncover each of the exhaust ports, causing air from the air supply to enter a corresponding latch to move the latch from the locked position to the unlocked position, wherein a corresponding threaded tubular may be disengaged from the latch to remove the threaded tubular from the fingerboard. The piston may also be moved in a retracting direction (opposite from the extending direction) to sequentially cover each of the exhaust ports, preventing air from entering a corresponding latch to move the latch from the unlocked position to the locked position.

Figure 1:
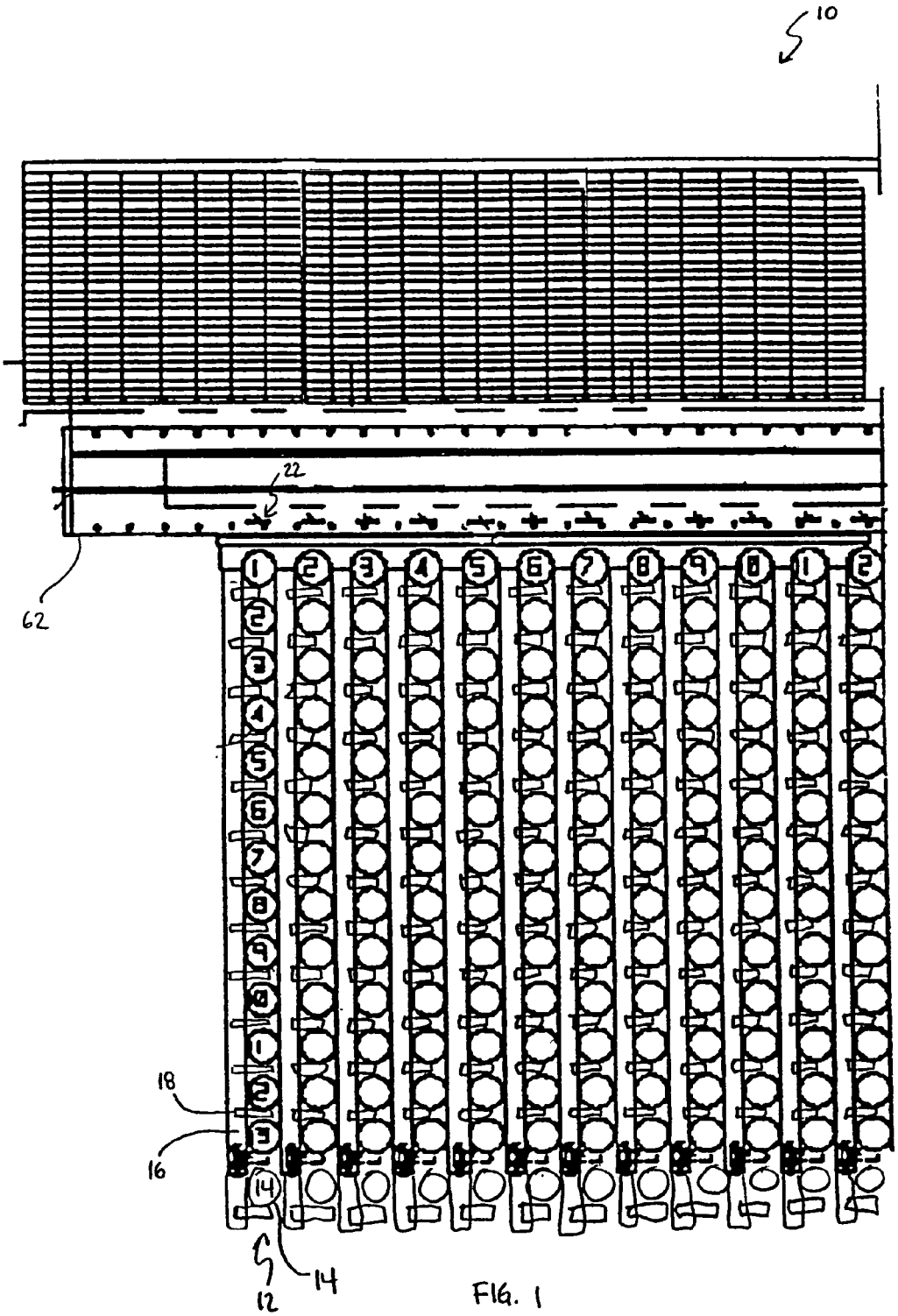
FIG. 1 is top view of a fingerboard according to one embodiment of the present invention.

FIG. 1 shows a fingerboard 10 according to one embodiment of the present invention. The fingerboard 10 includes a plurality of vertically elongated support structures 12 (hereinafter fingerboard rows 12) each capable of receiving a plurality of threaded tubulars 14 or a plurality of strings of joined threaded tubulars 14. Each fingerboard row 12 includes adjacent structures, or fingers 16, laterally spaced apart to receive the plurality of threaded tubulars 14. In the depicted embodiment, the fingerboard 10 includes twelve fingerboard rows 12 each receiving fourteen threaded tubulars 14. However, in other embodiments the fingerboard 10 may include any appropriate number of fingerboard rows 12 and each fingerboard row 12 may receive any appropriate number of threaded tubulars 14. Note that the numbers one through thirteen on the threaded tubulars 18 shown in the leftmost fingerboard row 12 of FIG. 1 and the numbers one through twelve on the uppermost threaded tubular 18 in each fingerboard row 12 are merely shown for reference purposes.

Figure 2:
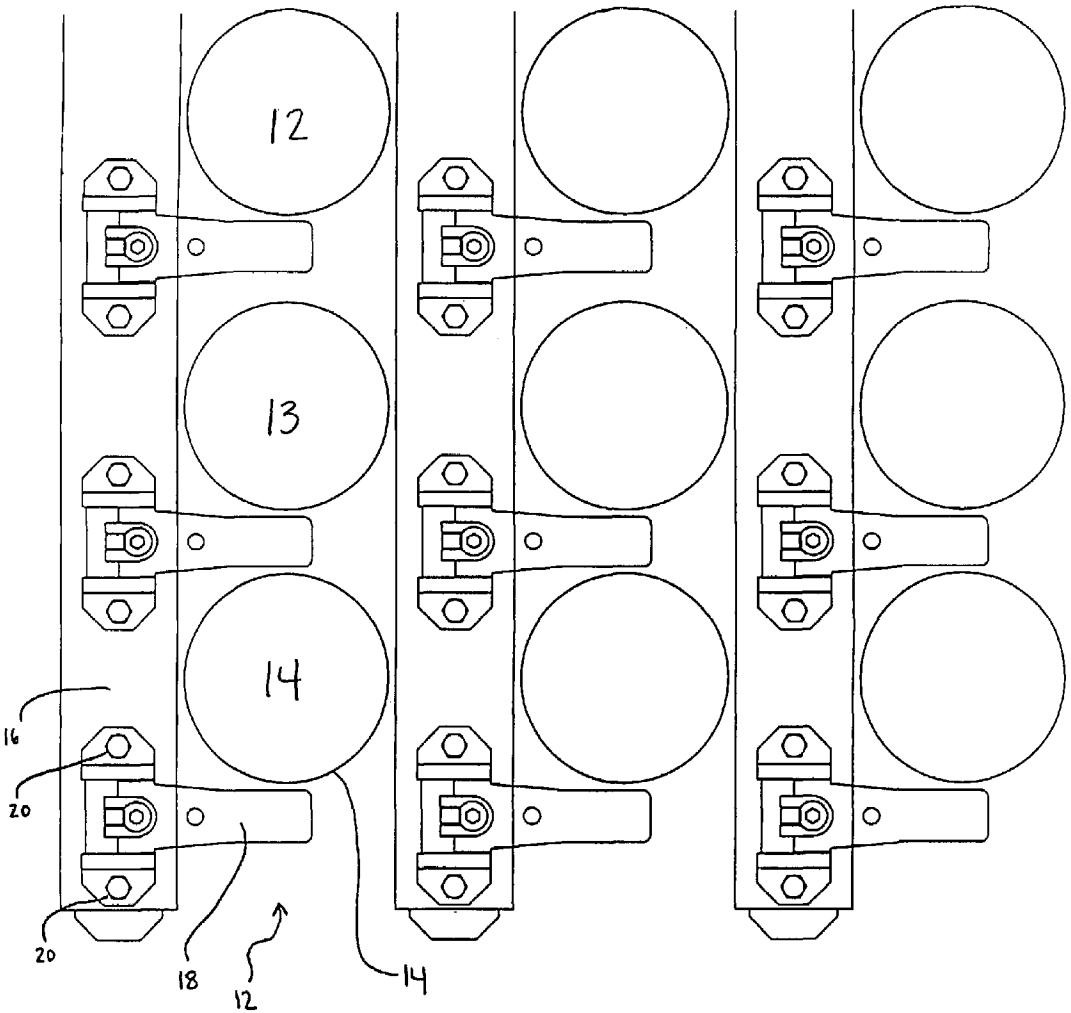
FIG. 2 is an enlarged view of a portion of the fingerboard of FIG. 1.

As shown in FIGS. 1 and 2, each fingerboard row 12 includes a plurality of corresponding latches 18. In the depicted embodiment, each latch 18 secures a corresponding threaded tubular 14 within its corresponding fingerboard row 12. However, in other embodiments each latch 18 may be used to secure more than one threaded tubular 14 to the latch's 18 corresponding fingerboard row 12. Each latch 18 is moveable between a locked position (as shown, for example in FIGS. 1, 2, 3 and 6A) and an unlocked position (as shown, for example in FIG. 6B). In the locked position, the latch 18 engages its corresponding threaded tubular 14 to secure the threaded tubular 14 within its corresponding fingerboard row 12. In the unlocked position, the latch 18 disengages its corresponding threaded tubular 18 to allow the threaded tubular 14 to be removed from its corresponding fingerboard row 12. In the unlocked position, the latch 18 also allows for the insertion of the threaded tubular 14 into its corresponding fingerboard row 12 and the securing of the threaded tubular 14 within its corresponding fingerboard row 12 by the moving of the latch 18 from the unlocked position to the locked position.

Each latch 18 may be mounted to its corresponding fingerboard row 12 by riveting, screw fastening, welding or any combination thereof, among other appropriate means. In the depicted embodiment, each latch 18 is mounted to its corresponding fingerboard row 12 by one or more nut and bolt connections 20 (see FIG. 2). Each latch 18 my be additionally secured to its corresponding fingerboard row 12 by creating an opening 22 in the fingerboard row 12 for each latch 18 and placing a portion of the latch 18 within its corresponding opening 22 (see FIG. 7).

FIGS. 4A–4E show the operation of one embodiment of a row controller 22. As shown in FIG. 1, each fingerboard row 12 includes the row controller 22 of FIGS. 4A–4E. Each row controller 22 controls the movement of the latches 18 within its corresponding fingerboard row 12 between the locked and unlocked positions.

Each row controller 22 includes a piston 24 moveable relative to a casing 26 and a piston guide 28 for guiding the piston 24. In the depicted embodiment, the piston 24 includes an elongated rod 30 and the casing 26 includes a plurality of exhaust ports 32. The elongated rod 30 is moveable relative to the casing 26 to cover or uncover each exhaust port 32. As used herein covering an exhaust port refers to blocking pressurized air from entering the exhaust port and does not necessarily refer to placing an object directly upon or directly over the exhaust port and uncovering an exhaust port refers to allowing pressurized air to enter the exhaust port.

Figures 4A, 4B, 4C, 4D, 4E:
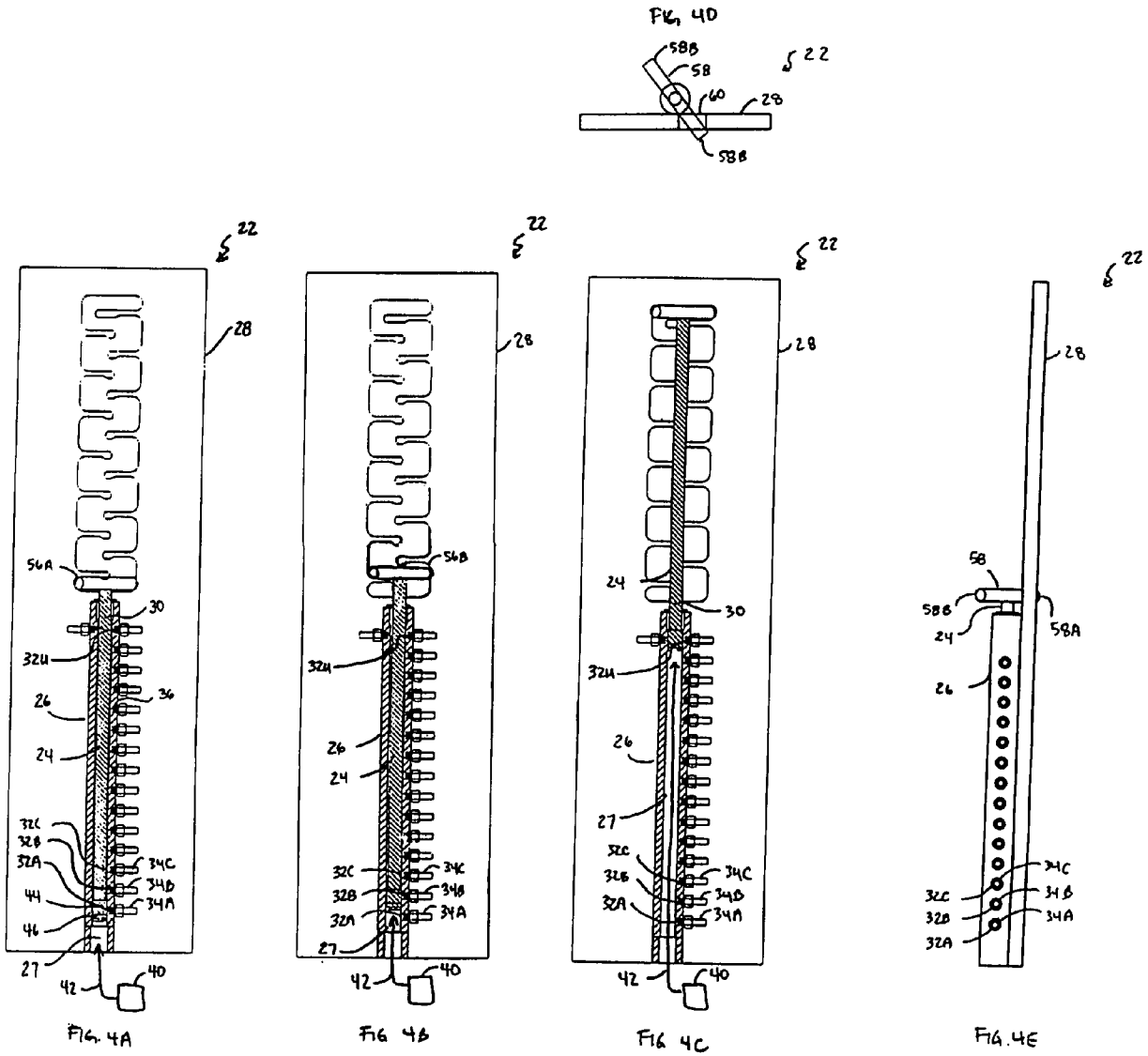
FIG. 4A is a front view of one embodiment of a row controller for use in a fingerboard according to one embodiment of the present invention, showing a piston in a fully retracted position with respect to a casing, wherein the piston and casing are shown in cross-section.
FIG. 4B is a front view of the row controller of FIG. 4A showing the piston in a partially extended position, wherein the piston and casing are shown in cross-section.
FIG. 4C is a front view of the row controller of FIG. 4A showing the piston in a fully extended position, wherein the piston and casing are shown in cross-section.
FIG. 4D is a top view of the row controller of FIG. 4A.
FIG. 4E is a side view of the row controller of FIG. 4A.

In the embodiment of FIGS. 4A–4C, the casing 26 is a hollow cylindrical casing 26 having an inner cavity 27. In this embodiment, the plurality of exhaust ports 32 are longitudinally spaced apart along the length of the casing 26 and each connect the casing's outer circumference to the casing's inner cavity 27.

In the depicted embodiment, the elongated rod 30 moves within the cylindrical casing 26 to cover the exhaust ports 32 from an interior surface of the casing 26. However in other embodiments, the elongated rod 30 may move exteriorly to the casing 26 to cover the exhaust ports 32 from an exterior surface of the casing 26. In addition, in other embodiments, the casing 26 may have a shape other than cylindrical, such as rectangular, square or any other appropriate shape.

Figure 5:
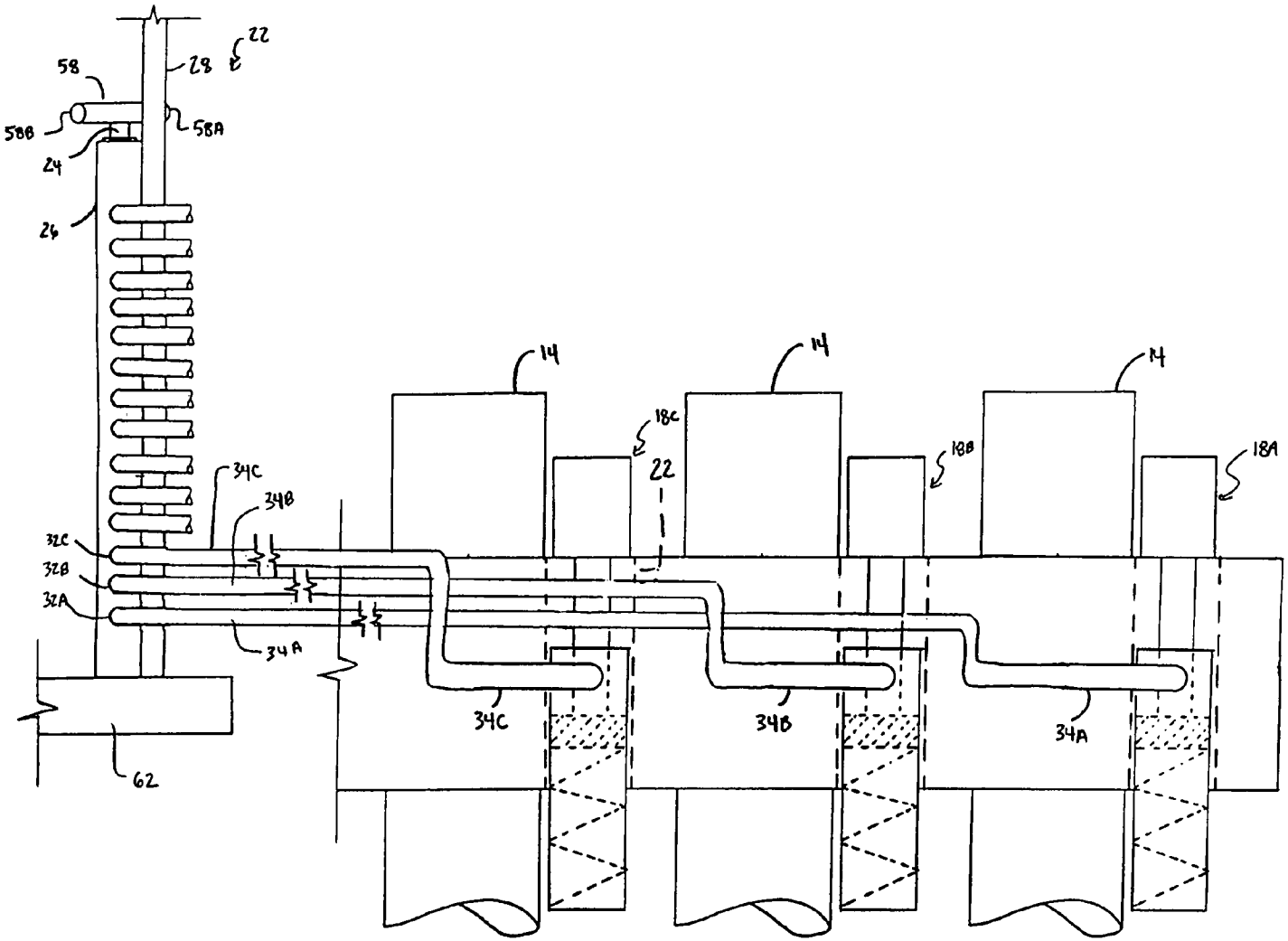
FIG. 5 is a side view of the row controller of FIG. 4A in use with the fingerboard of FIG. 1.

As shown in FIG. 5, each exhaust port 32 is connected to a corresponding latch 18. In this embodiment, each exhaust port 32 is connected to its corresponding latch 18 via a conduit 34, such as a flexible hose. For example a first exhaust port 32A is connected to a first latch 18A via a first conduit 34A, a second exhaust port 32B is connected to a second latch 18B via a second conduit 34B, a third exhaust port 32C is connected to a third latch 18C via a third conduit 34C, etc. To avoid over-cluttering of the figures, the remaining latches 18, exhaust ports 32 and conduits 34 are not labeled. In addition, unless specifically referred to otherwise the latches, exhaust ports and conduits will be generically referred to as latches 18, exhaust ports 32 and conduits 34).

Figure 6B:
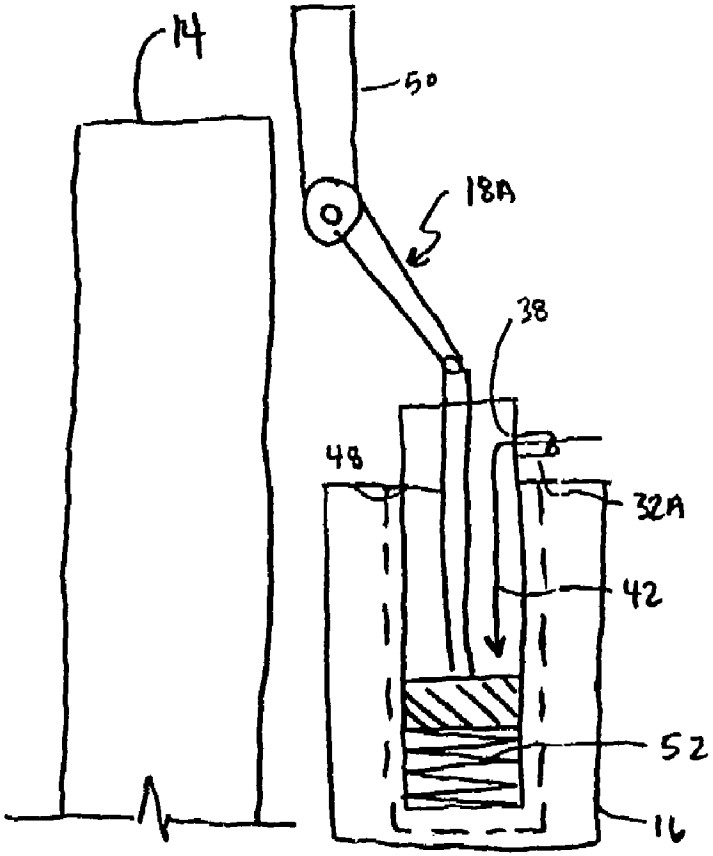
FIG. 6B is a side view of the latch of FIG. 6A shown in an unlocked position wherein a portion of the latch is in cross-section.
Figure 6A:
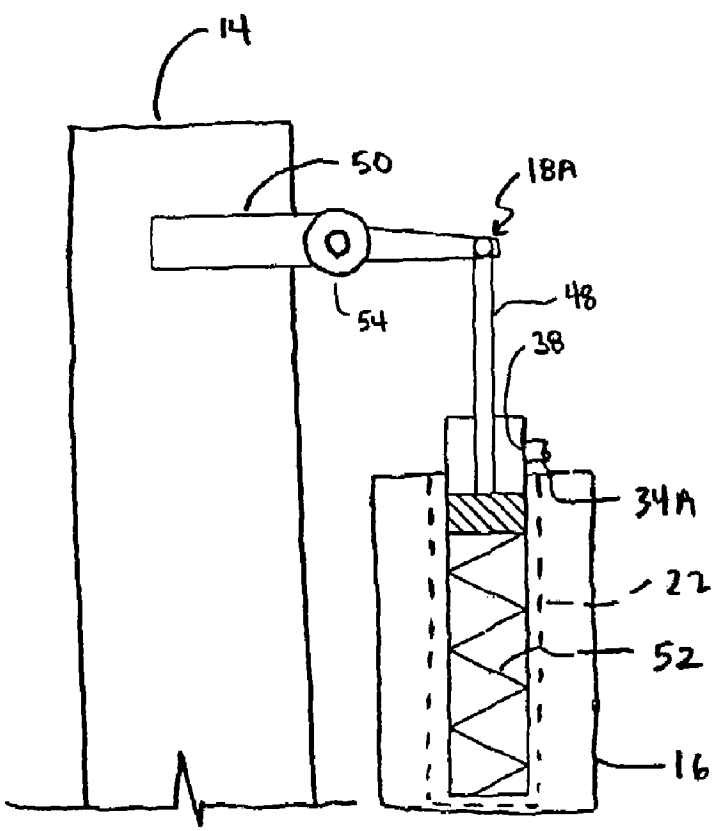
FIG. 6A is a side view of the fingerboard of FIG. 1, showing a latch a locked position, wherein a portion of the latch is in cross-section.

As shown in FIGS. 4A–5, each conduit 34 is connected at its first end to a corresponding exhaust port 32 and at its second end to the exhaust port's 32 corresponding latch 18. As shown in FIG. 4A, the first end of each conduit 34 may be attached to its corresponding exhaust port 32 by a threaded connection 36. As shown in FIGS. 6A and 6B, the second end of each conduit 34 may be similarly threadably engaged to an inlet port 38 of its corresponding latch 18.

An air source 40 (represented schematically in FIGS. 4A–4C) is connected to the casing 26 of each row controller 22. The air source 40 supplies pressurized air 42 to the row controller 22. The fingerboard 10 may have one air source 40 that supplies pressurized air 42 to each of the row controllers 22 or each row controller 22 may have an individual air source 40. In one embodiment, each row controller 22 is connected to the rig air pressure, which applies pressurized air 42 at approximately one hundred psi (one hundred pounds per square inch) to each casing 26.

As shown in FIGS. 4A–4C, the pressurized air 42 enters the inner cavity 27 from a lower end of the casing 26 (as used herein, terms such as "above", "below", "upper", "lower", "right" and "left" are relative terms and do not necessarily denote the actual position of an element). The pressurized air 42 fills the inner cavity 27 in the space below a head 44 of the elongated rod 30. The head 44 of the elongated rod 30 includes a sealing element 46 such as an electrometric o-ring. In one embodiment, the head 44 includes a circumferential groove that receives the sealing element 46. The sealing element 46 prevents the pressurized air 42 from moving above the sealing element 46 within the inner cavity 27. As such, the pressurized air 42 can only enter into the exhaust ports 32 that are uncovered. In this embodiment, an exhaust port 32 is uncovered when the sealing element 46 is moved to a position above the exhaust port 32 (i.e. by moving the elongated rod 30 until its sealing element is above the desired exhaust port 32.)

In the depiction of FIG. 4A, the elongated rod 30 is in a fully retracted position. In this position, the elongated rod 30 covers each of the exhaust ports 32 (i.e. the sealing element 46 is positioned below each of the exhaust ports 32). In the depicted of FIG. 4B, the elongated rod 30 has been moved upwardly to a first extended position, such that the sealing element 46 is positioned above the first exhaust port 32A and below the remaining exhaust ports 32. As such, the first exhaust port 32A is uncovered allowing the pressurized air 42 to enter the first exhaust port 32A and the remaining exhaust ports 32 are covered preventing the pressurized air 42 from entering the remaining exhaust ports 32.

As described in detail below and referring again to FIGS. 4A–6B, when an exhaust port 32 is uncovered, its corresponding latch 18 is held in the unlocked position; and when an exhaust ports 32 is covered, its corresponding latch 18 is held in the locked position. For example, when the first exhaust port 32A is uncovered, the pressurized air 42 enters the first exhaust port 32A, traverses the first conduit 34A, and enters the inlet port 38 of the first latch 18A. As shown in FIGS. 6A and 6B, when the pressurized air 42 enters the inlet port 38 of the first latch 18A, a latch piston 48 is moved downwardly, causing a latch arm 50 to move such that the first latch 18A is moved form the locked position (FIG. 8A) to the unlocked position (FIG. 8B). In this example, when the latch arm 50 is in a locked position, the first latch 18A is in the locked position and when the latch arm 50 is in an unlocked position, the first latch 18A is in the unlocked position.

In the depicted embodiment of FIGS. 6A and 6B, the latch piston 48 is attached to a biasing element 52, such as a compression spring. The biasing element 52 biases the latch piston 48 in an upward direction such that the latch arm 50 is biased in its locked position. When the pressurized air 42 enters the inlet port 38 of the first latch 18A, the pressurized air 42 exerts a force on the latch piston 48 that overcomes the force of the biasing element 52, causing the latch piston 48 to move downward and the latch arm 50 to rotate about pivot 54 to move from its locked position to its unlocked position. When the pressurized air 42 no longer exerts a force on the latch piston 48 (which occurs when the first exhaust port 32A is covered) the biasing element 52 forces the latch piston 48 upwardly, causing the latch arm 50 to rotate about pivot 54 to return the latch arm 50 to its locked position. Although the above description refers to the first latch 18A, each of the other latches 18 may be moved between the locked and unlocked positions in the same manner as described above for the first latch 18A. In addition, although the latch 18 has been described as including a latch arm 50 that is biased in its locked position, the system may be reversed to bias the latch arm 50 in the unlocked position.

FIG. 4B shows the elongated rod 30 in a first extended position. In the first extended position the first exhaust port 32A is uncovered and the remaining exhaust ports 32 are covered. In one embodiment, the elongated rod 30 has a plurality of extended positions, wherein the number of extended positions corresponds to the number of exhaust ports 32, such that each successively higher extended position sequentially uncovers a corresponding exhaust port 32.

FIG. 4C shows the elongated rod 30 in a fully extended position. In the fully extended position, all of the exhaust ports 32 are uncovered. As shown in FIGS. 4A–4C, the casing 26 may include upper exhaust ports 32U. The upper exhaust ports 32U provide openings to the atmosphere that prevent the latches from opening when there is a leak in the sealing element 46 of the elongated rod 30.

FIGS. 4A–4C show one embodiment of the piston guide 28 of the row controller 22. The piston guide 28 includes a plurality of stops 56, wherein the number of stops 56 corresponds to the number of extended positions of the elongated rod 30 plus the fully retracted position of the elongated rod 30, such that each successive stop 56 corresponds to a successive extended position of the elongated rod 30 and each successively higher extended position of the elongated rod 30 sequentially uncovers a corresponding exhaust port 32.

For example, in FIG. 4A the piston 26 is engaged with a first stop 56A and the elongated rod 30 is in the fully retracted position (unless specifically referred to otherwise the stops will be generically referred to as stops 56). In FIG. 4B, the piston 26 is engaged with a second stop 56B and the elongated rod 30 is in a first extended position, such that the first exhaust port 32A is uncovered. By moving the piston 26 to engage successively higher stops 56, each exhaust ports 32 is sequentially uncovered.

As shown in FIGS. 4A–4C, the pressurized air 42 biases the elongated rod 30 upward toward a fully extended position. The piston guide 28 allows the biasing force of the pressurized air 42 to move the elongated rod 30 from one 56 stop to the next successively higher stop 56 but prevents the biasing force of the pressurized air 42 from moving the elongated rod 30 from the fully retracted position directly to the fully extended position. As such, the piston guide 28 allows the exhaust ports 32 to be individually and sequentially uncovered and hence allows each of the latches 18 to be individually and sequentially opened. As used herein opening a latch refers to a movement of the latch from the locked to the unlocked position and closing a latch refers to a movement of the latch from the unlocked to the locked position.

In addition, by applying a force that overcomes the biasing force of the pressurized air 42, the elongated rod 30 may be moved to successively lower stops 56 allowing the exhaust ports 32 to be individually and sequentially covered and hence allowing each of the latches 18 to be individually and sequentially closed. In one embodiment the pressurized air 42 is pressurized at approximately one hundred psi and the biasing force is approximately seven lbs. (seven pounds). Hence, in this embodiment the biasing force of the pressurized air 42 may be overcome by applying a downward force of greater than seven lbs. to the piston 26.

In one embodiment, the piston 26 is manually moveable, such that the elongated rod 30 may be manually moved between each of the stops 56. For example, in the embodiment of FIGS. 7 and 8, the piston guide 28 is a plate having a multi S-shaped guide 60, wherein the multi S-shaped guide 60 is formed as a lateral groove or a lateral opening in the plate. The piston 26 includes a handle 58 having a first end 58A that engages the stops 56 of the multi S-shaped guide 60 and a second end 58B that is manually movable.

Figure 7:
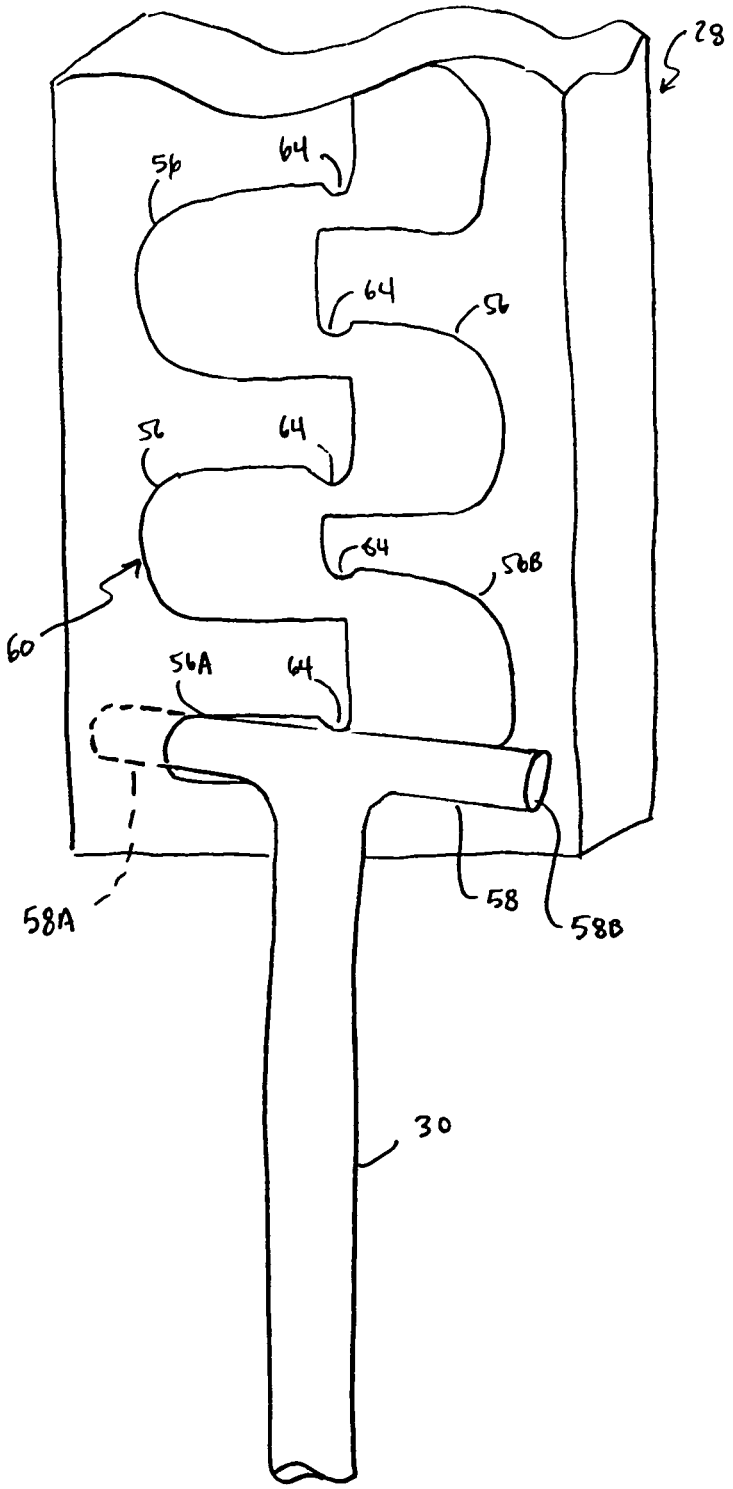
FIG. 7 is a perspective view of the piston of FIG. 4A engaging a piston guide of the row controller of FIG. 4A at a first stop position.
Figure 8:
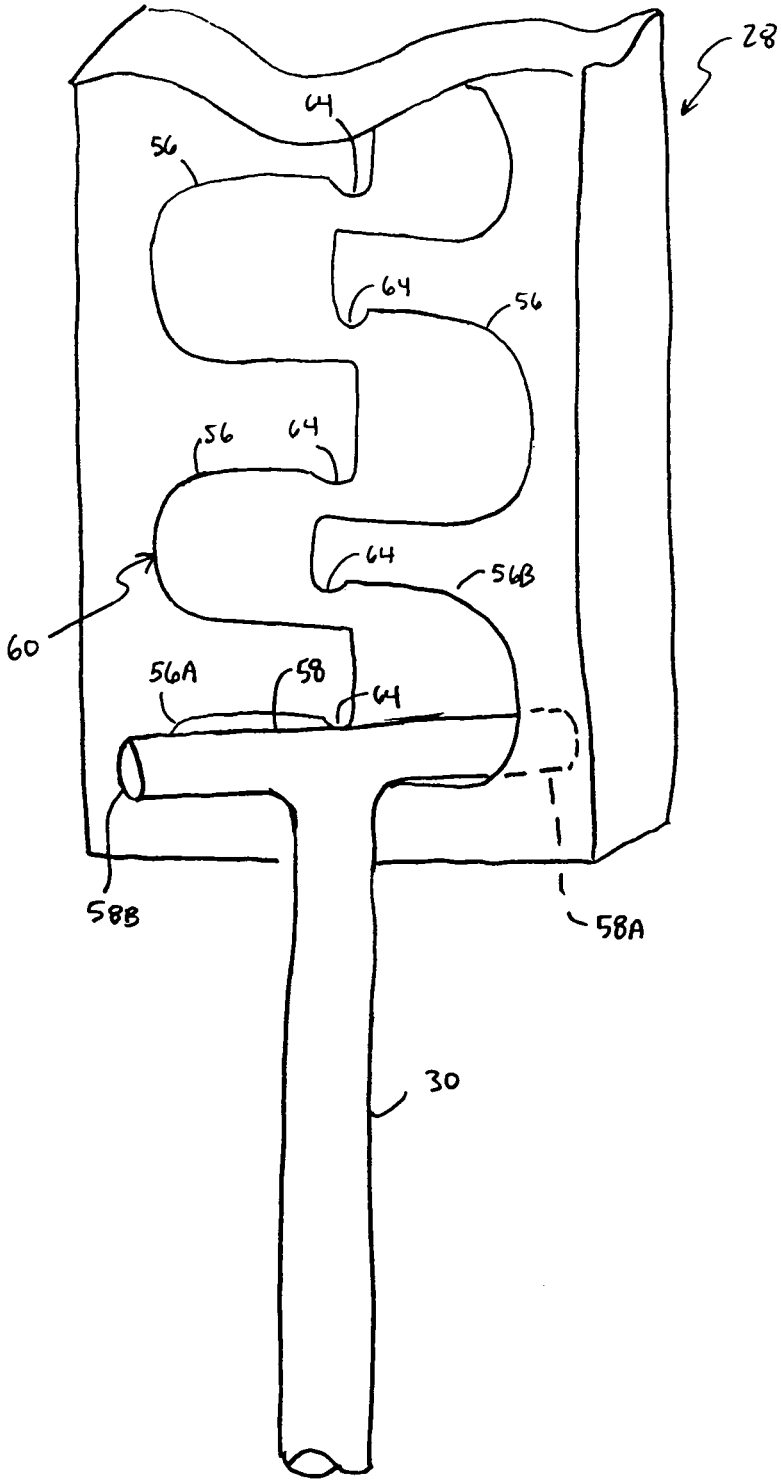
FIG. 8 is a perspective view of the piston of FIG. 4A moved out of engagement with the first stop position of the piston guide of the row controller of FIG. 4A.

In FIG. 7, the first end 58A of the handle 58 is engaged with the first stop 56A of the piston guide 28, the first end 58A of the handle 58 may be disengaged with the first stop 56A and engaged with the second stop 56B by grasping and rotating the second end 58B of the handle 58 towards the first stop 56A. This causes the first end 58A of the handle 58 to correspondingly rotate toward the second stop 56B. When the first end 58A of the handle 58 reaches an end of the multi S-shaped guide 60 (as shown in FIG. 8) the handle may be released to allow the biasing force of the pressurized air 42 to move the first end 58A of the handle 58 into engagement with the second stop 56B. The piston 26 may be similarly raised to engage successively higher stops 56 by repeatedly rotating the handle 58 in this manner. By reversing the above steps, the piston 26 may be lowered to engage successively lower stops 56. In one embodiment, the multi S-shaped guide 60 includes a plurality of detents 64 that prevent the piston handle 58 from inadvertently moving from a lower stop 56, such as the first stop 56A, to a higher stop 56, such as the second stop 56B.

Figure 3:
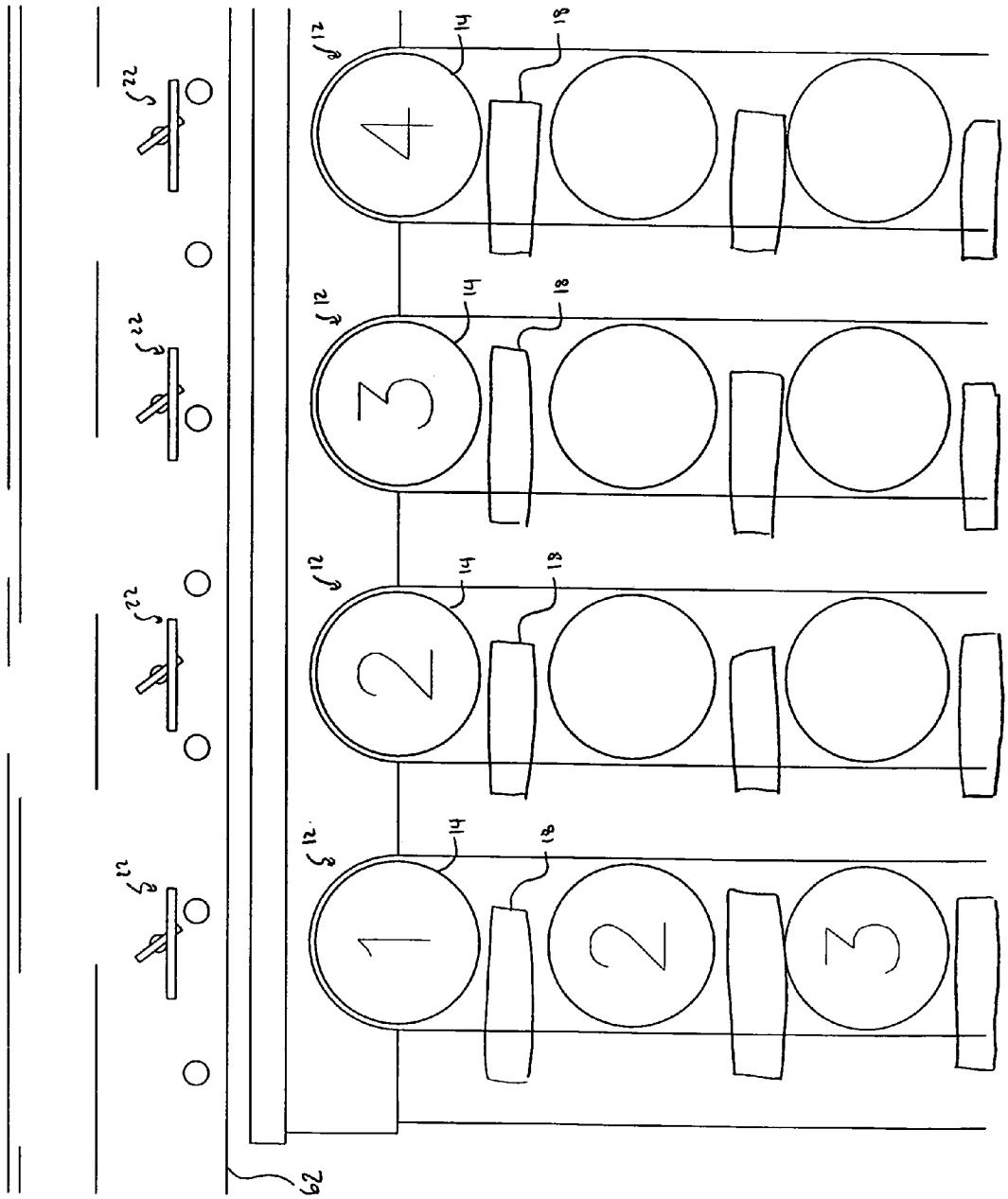
FIG. 3 is an enlarged view of another portion of the fingerboard of FIG. 1.

Each row controller 22 may be secured to the fingerboard 10 at a position remote from the latches 18, such that the latches 18 may be manually opened and closed from a position remote from the location of the latches 18. For example, as shown in FIGS. 1 and 3, each row controller 22 is secured to a support structure 62, such as a catwalk, that is remote from the latches 18.

The preceding description has been presented with reference to various embodiments of the invention. Persons skilled in the art and technology to which this invention pertains will appreciate that alterations and changes in the described structures and methods of operation can be practiced without meaningfully departing from the principle, spirit and scope of this invention.

What is claimed is:

1. A fingerboard comprising:

at least one fingerboard row for storing a plurality of threaded tubulars;

a plurality of latches connected to the at least one fingerboard row for lockingly retaining at least one threaded tubular, wherein each of the plurality of latches is movable between a locked position and an unlocked position; and a row controller connected to each of the latches for individually and sequentially moving the latches between the locked and unlocked positions, wherein the row controller is manually operable from a location remote from the latches such that the latches are manually and remotely controlled.

2. The fingerboard of claim 1, wherein the row controller further comprises a piston having an elongated rod slidably disposed within a casing, and wherein the casing is connected to each of the plurality of latches such that movements of the elongated rod relative to the casing causes said individual and sequential movement of the latches between the locked and unlocked positions.

3. The fingerboard of claim 2, wherein the elongated rod is movable between a fully retracted position and a plurality of extended positions corresponding to each of the plurality of latches, such that in the fully retracted position each of the plurality of latches are in the locked position, and in each successive one of the plurality of extended positions a successive one of the corresponding plurality of latches is moved from the locked position to the unlocked position.

4. The fingerboard of claim 3, further comprising an air source connected to the casing, and wherein the casing has a plurality of exhaust ports in fluid connection therewith, and wherein each exhaust port corresponds to one of the plurality of latches, and wherein in the fully retracted position each of the exhaust ports are covered by the elongated rod such that air from the air source cannot flow therethrough allowing each of the corresponding latches to be biased in the locked position, and wherein in each successive one of the plurality of extended positions a successive one of the plurality of exhaust ports is uncovered such that air flows through said exhaust port to force a successive one of the corresponding latches to be moved from the locked position to the unlocked position.

5. The fingerboard of claim 3, wherein the row controller further comprises a piston guide into which at least a portion of the piston is slidingly engaged; wherein the piston guide includes a plurality of stop positions; and wherein each of the stop positions corresponds to either the fully retracted position of the elongated rod or to one of the plurality of extended positions of the elongated rod.

6. The fingerboard of claim 5, wherein the piston comprises a handle that is slidingly connected to the piston guide, such that successive movements of the handle causes the handle to engage a successive one of the plurality of stop positions.

7. The fingerboard of claim 5, wherein the piston guide comprises a multi-S-shaped guide, and wherein each end of each S-shape defines one of the stop positions.

8. The fingerboard of claim 5, wherein the piston is manually moveable to each of the plurality of stop positions.

9. A fingerboard comprising:

at least one fingerboard row for storing a plurality of threaded tubulars;

a plurality of latches connected to the at least one fingerboard row, wherein each of the plurality of latches is biased into a locked position and movable between the locked position and an unlocked position;

a piston having an elongated rod that is slidingly engaged with a casing, wherein the casing has a plurality of exhaust ports in fluid connection therewith, and wherein each of the plurality of exhaust ports is connected to a corresponding one of the plurality of latches; and an air source in fluid connection with the casing, wherein the elongated rod is movable between a fully retracted position and a plurality of extended positions corresponding to each of the plurality of exhaust ports, wherein in the fully retracted position each of the exhaust ports are covered by the elongated rod, such that air from the air source cannot flow therethrough allowing each of the corresponding latches to be biased in the locked position, and wherein in each successive one of the plurality of extended positions a successive one of the plurality of exhaust ports is uncovered such that air flows therethrough to force a successive one of the corresponding latches to move from the locked position to the unlocked position.

10. The fingerboard of claim 9, wherein the piston is manually moveable, such that the latches are manually controlled.

11. The fingerboard of claim 9, wherein the piston is manually moveable from a position remote from the plurality of latches, such that the latches are manually and remotely controlled.

12. The fingerboard of claim 9, further comprising a piston guide into which the piston is slidingly engaged, the piston guide having a plurality of stop positions, and wherein the piston is engageable to each of the stop positions and each of the stop positions corresponds to either the fully retracted position or to one of the plurality of extended positions of the elongated rod.

13. The fingerboard of claim 12, wherein the piston comprises a handle that is slidingly connected to the piston guide, such that successive movements of the handle causes the handle to engage successive ones of the plurality of stop positions.

14. The fingerboard of claim 12, wherein the piston guide comprises a multi-S-shaped guide, and wherein each end of each S-shape defines one of the stop positions.

15. The fingerboard of claim 9, wherein the elongated rod is biased away from the fully retracted position by air from the air source.

16. A fingerboard comprising:

at least one fingerboard row for storing a plurality of threaded tubulars;

a plurality of latches connected to the at least one fingerboard row, wherein each of the plurality of latches is biased into a locked position and movable between the locked position and an unlocked position;

a piston having an elongated rod that is slidingly engaged with a casing, wherein the casing has a plurality of exhaust ports in fluid connection therewith, a plurality of conduits, wherein each of the plurality of conduits fluidly connects one of the plurality of exhaust ports to a corresponding one of the plurality of latches;

an air source in fluid connection with the casing, wherein the elongated rod is movable between a fully retracted position and a plurality of extended positions corresponding to each of the plurality of exhaust ports, wherein in the fully retracted position each of the exhaust ports are covered by the elongated rod, such that air from the air source cannot flow therethrough allowing each of the corresponding latches to be biased in the locked position, and wherein in each successive one of the plurality of extended positions a successive one of the plurality of exhaust ports is uncovered such that air flows therethrough to force a successive one of the corresponding latches to move from the locked position to the unlocked position; and a piston guide connected to the piston and having a plurality of stop positions, wherein each of the plurality of stop positions corresponds to one of the plurality of extended positions of the elongated rod.

17. The fingerboard of claim 16, wherein the piston is manually moveable, such that the latches are manually controlled.

18. The fingerboard of claim 16, wherein the piston is manually moveable from a position remote from the plurality of latches, such that the latches are manually and remotely controlled.

19. The fingerboard of claim 16, wherein the piston comprises a handle that is connected to the piston guide, such that successive movements of the handle causes the handle to engage successive ones of the plurality of stop positions.

20. The fingerboard of claim 16, wherein the piston guide comprises a multi-S-shaped guide, and wherein each end of each S-shape defines one of the stop positions.

21. A method of storing a plurality of threaded tubulars in a fingerboard comprising:

providing a fingerboard row for storing the plurality of threaded tubulars;

providing a casing having a plurality of exhaust ports, wherein each of the plurality of exhaust ports corresponds to at least one of the plurality of threaded tubulars;

providing a piston having an elongated rod that is moveable relative to the casing;

connecting a plurality of latches to the fingerboard row, wherein each of the plurality of latches is connected to a corresponding one of the plurality of exhaust ports and each latch is biased to a closed position and moveable between the closed position and an opened position;

connecting an air source to the casing;

moving the elongated rod to a fully extended position such that each exhaust port is uncovered by the elongated rod and air from the air source enters each uncovered exhaust port and forces each of the latches into a unlocked position;

adding successive ones of the plurality of threaded tubulars to a position within the fingerboard row; and moving the elongated rod to one of a plurality of retracted positions to cover the corresponding exhaust port of each added threaded tubular causing each latch to be biased from the unlocked position to the locked position to lock each added threaded tubular to the fingerboard row.

22. The method of claim 21, wherein the piston is manually moveable, such that the latches are manually controlled.

23. The method of claim 21, wherein the piston is manually moveable from a position remote from the plurality of latches, such that the latches are manually and remotely controlled.

24. The method of claim 21, further comprising releasing successive ones of the locked threaded tubulars by moving the elongated rod to uncover the corresponding exhaust port of each threaded tubulars to be removed forcing each latch to be moved from the locked position to the unlocked position and allowing each unlocked threaded tubulars to be removed from the fingerboard row.

25. The method of claim 22, further comprising connecting the piston to a piston guide that has a plurality of stop positions, wherein each of the plurality of stop positions corresponds to one of the plurality of retracted positions of the elongated rod.

26. The method of claim 22, wherein each of the plurality of latches is biased toward the locked position.

* * * * *